United States Patent [19]

Hayes et al.

[11] Patent Number: 4,492,240

[45] Date of Patent: Jan. 8, 1985

[54] SMOKE FILTER

[76] Inventors: Ernest B. Hayes, 14 Heath Ct., Leighton Buzzard, Bedfordshire; Anthony S. Cantell, 20 Willow Grove, Old Stratford, Milton Keynes, Buckinghamshire both of England

[21] Appl. No.: 391,357

[22] Filed: Jun. 23, 1982

[30] Foreign Application Priority Data

Jul. 6, 1981 [GB] United Kingdom ..... 8120821

[51] Int. Cl.[3] ..... A24D 3/04

[52] U.S. Cl. ..... 131/336; 131/338; 131/339

[58] Field of Search ..... 131/336, 365, 361, 338, 131/339, 340

[56] References Cited

U.S. PATENT DOCUMENTS

| | | | |
|---|---|---|---|
| 3,490,461 | 1/1970 | Osmalov et al. | 131/336 |
| 3,596,663 | 8/1971 | Schultz et al. | 131/336 |
| 4,256,122 | 3/1981 | Johnson et al. | 131/336 |

FOREIGN PATENT DOCUMENTS

| | | |
|---|---|---|
| 1358685 | 7/1974 | United Kingdom . |
| 1488972 | 10/1977 | United Kingdom . |

*Primary Examiner*—V. Millin
*Attorney, Agent, or Firm*—Holman & Stern

[57] ABSTRACT

This invention provides a smoke filter element comprising a filtering core, a smoke impermeable wrapper in surrounding engagement with the core, at least one internal passage defined between the impermeable wrapper and core and open at an end of the element, and at least one external passage defined by the outer surface of the impermeable wrapper and extending to an end of the element; and a cigarette filter comprising such an element having engaged around said impermeable wrapper tipping material which provides, when the filter is drawn on in use, for the ingress of external air laterally therethrough into said external passage(s). The tipping material may be a tipping overwrap incorporating the filter in a filtered cigarette. The impermeable wrapper may have longitudinal corrugations providing the passages, which may extend fully or only partially the length of the wrapper. The impermeable wrapper can have a circumferential groove communicating with the external passage(s), there being air dilution through the tipping material directly into the groove.

16 Claims, 20 Drawing Figures

SMOKE FILTER

This invention relates to smoke filtration, especially tobacco smoke filtration. It provides filters and elements which are widely applicable for smoke and other filtering uses, but which are discussed and illustrated herein mainly in terms of cigarette filters, this being the application of currently greatest commerical interest. The invention provides a smoke filter element comprising a filtering core, a smoke impermeable wrapper in surrounding engagement with the core, at least one (internal) passage defined between the impermeable wrapper and core and open at an end of the element, and at least one further (external) passage defined by the outer surface of the impermeable wrapper and extending to an end of the element. Suitably the impermeable wrapper is profiled to provide the internal and external passages, e.g. it may be longitudinally grooved or corrugated to provide the said passages; accordingly the invention also provides a smoke filter element comprising a filtering core, and a corrugated smoke impermeable wrapper defining first (internal) passages between the wrapper and core which extend longitudinally to an end of the element and further (external) passages externally of the wrapper which extend longitudinally to an end of the element.

Elements according to the invention are intended primarily for use as filters with tipping material which provides, when the filter is drawn on in use, for the ingress of external air laterally therethrough into the further (external) passages. Such ventilating tipping material may be applied around the impermeable wrapper as a step in the filter manufacturing procedure, or it may be the tipping overwrap which is applied to join element to tobacco rod in the manufacture of filter cigarettes. Accordingly the invention further provides a cigarette filter comprising a filtering core, a smoke impermeable wrapper in surrounding engagement with the core, tipping material in surrounding engagement with the impermeable wrapper, at least one (internal) passage defined between the impermeable wrapper and core and open at an end of the filter, and at least one further (external) passage defined between the impermeable wrapper and tipping material and open at an end of the filter, the tipping material providing, when the filter is drawn on in use, for the ingress of external air laterally therethrough into said further (external) passage(s).

The passages may extend only partially the length of the element or filter but one, more, or all can instead extend from one element or filter end to the other; any given passage may be of substantially constant cross-section along its length, or could (especially if it extends from end to end of the filter or element) be constricted over a terminal and/or intermediate region. The passages may extend axially of the element or filter or follow a curved path.

Where the impermeable wrapper is formed with longitudinal grooves or corrugations to provide said passages, the grooves or corrugations may thus extend the full wrapper length (though possibly with the grooves or corrugations being smaller at an end or intermediate region), or may terminate (e.g. at an uncorrugated or circumferentially grooved or corrugated region) to close one or more passages (at least in the complete filter) at a terminal or intermediate portion of the wrapper. Other profiled configurations of the impermeable wrapper are possible for defining the said passages (e.g. dimples).

In particularly preferred embodiments of the present invention, the impermeable wrapper has a circumferential groove into which at least one said external passage opens, this groove usually simultaneously closing the internal passage(s). In filter cigarettes according to the invention employing such elements, there can be ventilation through the tipping material directly into the circumferential groove and hence into the communicating external passage(s); for example, ventilating perforations may be provided in the tipping material in a circumferential ring in register with the circumferential groove. Various configurations are possible; for example, the circumferential groove may be disposed midway along the wrapper, with internal and external passages extending therefrom in opposite directions to both ends of the element; or the circumferential groove may be towards one end of the element where the impermeable wrapper is circumferentially corrugated or otherwise conformed to close the circumferential groove from that end, the internal and external passages extending from the circumferential groove to the other end of the element; in another variant, the circumferential groove is at one end of the wrapper, being open to that end with the internal and external passages extending therefrom to the other end; other embodiments have a plurality of the circumferential grooves spaced along the wrapper, e.g. at opposite ends thereof. The impermeable wrapper to be employed in the production of this type of element according to the invention can simply be pre-profiled in the normal way to provide the required passages, with each region to constitute a circumferential groove being left plain and unprofiled; when the profiled wrapper is applied round the core, it is found that the said plain unprofiled regions naturally adopt the conformation of circumferential grooves. This is especially effective in the case of corrugation to provide the passages.

When an embossed or otherwise shaped impermeable wrapper provides the said passages, the core is suitably of substantially constant circular section and the tipping material likewise in the form of a substantially right circular cylinder.

When they do not extend the full wrapper length, the internal and external passages will usually be open at the same end of the element or filter, and will usually be closed at the same position along its length, e.g. at its other end, but neither of these features is essential; the former and latter passages can be closed at different longitudinal positions each of which may be at an end of the element or filter or between its ends.

The filtering core of the element or filter of the invention can be of any of the whole range of cigarette filter materials, e.g. of bonded or unbonded staple fibres or filamentary tow (of cellulose acetate, or polyolefin etc), creped paper, or air-permeable foamed material. The core may be of uniform or non-uniform structure and composition along its length; it may be integral or of composite structure—e.g. incorporating a wrapper and/or having separate plugs of the same or differing characteristics (e.g. pressure drop) and/or composition; the core may extend wholly or only partially the length of the element or filter, and where the core is a composite of two or more plugs adjacent plugs may abut or be spaced apart. The core may be unwrapped or include a plugwrap which is perforate and/or of inherently smoke-permeable material; the core could instead have an impermeable plugwrap or integral (e.g. heat- or solvent-fused) skin. The core may incorporate particulate additive uniformly dispersed therethrough or localised in at least one region or inter-plug space; the core may have a profiled (e.g. longitudinally grooved) periphery, and it may have one or more internal passages or cavities which may be filled or unfilled. The core may include one or more components which do not have a filtering effect but which merely serve to increase the pressure drop; and there may be used as or in the filtering core of elements and filters according to the invention a high pressure drop, low retention plug of gathered coarse fibres or of gathered embossed plastics, metal (e.g. aluminum) or other foil. In some embodiments the impermeable wrapper surrounds a cavity or recess open at an end of the filter element or filter, and in use such a recess or cavity may be disposed against the wrapped tobacco rod or exposed at the buccal end of the filtered cigarette.

Whilst the filtering core of elements according to the invention may be a composite structure as mentioned above, e.g. made up of abutting or longitudinally spaced plugs, the profiled impermeable wrapper which extends the full element length renders the element overall a coherent, unitary structure.

The impermeable wrapper is suitably a paper/thermoplastics polymer laminate, e.g. a paper/thermoplastics/paper laminate, the plastics layer preferably being of polyolefin, e.g. polyethylene. Such a laminate has good embossing characteristics and retains its impermeability and embossed configuration well. The impermeable wrapper is preferably secured around the core by way of a lapped and stuck seam; it may also or instead be secured to the core by one or more longitudinal adhesive lines.

The tipping material may be air-permeable, but when it is the tipping overwrap joining the element to a tobacco column it is more usually of substantially impermeable material having perforations in open communication with the said further passages. The element may have a wrap of air-permeable material, giving a filter of plain external appearance and around which the tipping overwrap (or ring tipping) is engaged in filter cigarette manufacture, but this is not usually necessary.

In use as part of a filtered cigarette, the filter according to the invention can provide (via the internal passage(s) between impermeable wrapper and core) for some by-pass of smoke around part of the core length, various controlled effects being thereby obtainable according to the filter structure adopted as illustrated in some of the specific embodiments described below; in these cases, of course, the core does not have a smoke-impermeable layer between itself and the impermeable wrapper. The external passage(s), between impermeable wrapper and tipping material, may be open to the buccal end and such that ventilation air is drawn thereinto and passes directly into the smoker's mouth with little or no previous mixing with smoke. An external passage may instead open at the tobacco rod end and be such that ventilation air drawn thereinto passes upstream to the tobacco rod and then downstream through the filter core. Constriction of a passage may affect or determine the degree and direction of flow in its unconstricted portions(s). A filter according to the invention may have at least one external passage open only at the buccal end and at least another such passage open only at the other end; likewise, at least one internal passage may open only at the buccal end and at least one other open only at the other end.

Elements according to the invention are suitably made by first forming the core (as a continuous or discrete finite length rod), profiling (e.g. corrugating) the impermeable wrapper to the required configuration, and wrapping and securing the profiled impermeable wrapper around the core; tipping material may subsequently be wrapped around the impermeable wrapper; this tipping material may be the tipping overwrap which is employed to join element and tobacco rod together during formaion of filter cigarettes in conventional manner.

Normally the core will be formed as a continuous rod which is then continuously wrapped in the pre-profiled impermeable wrapper, the resulting continuous composite then being cut transversely into finite lengths. A wrap of air-permeable material may if desired be applied continuously around the composite of core and profiled wrapper before the cutting into finite lengths. For filter cigarette manufacture, a double length such product is disposed with a wrapped tobacco rod abutting either end, ventilating tipping overwrap is applied to join the tobacco rods and intervening element or filter rod together, and the resulting combination is cut in half to produce two filter cigarettes. The initially produced continuous filter or element is normally cut into even multiple (e.g. sextuple) length units for supply to the filter cigarette manufacture who then cuts these multiple lengths into double lengths for use in filter cigarette production as described above. It will be appreciated that, in the case of individual filter or element lengths according to the invention in which the internal and external passages extend from one end only to terminate short of the other end so that the two filter or element ends are different, the initial even multiple length rods supplied by the filter manufacturer and from which the individual lengths are eventually formed can have identical ends—e.g. the even multiple length rod could have passages extending from both ends or closed at both ends, according to whether the passages in the final filter cigarette are to be open to the tobacco or at the buccal end respectively. Such double and multiple length rods also form part of the present invention.

The impermeable wrapper preferably exerts substantially no radial compression on the core and preferably does not impress its profiled configuration into the core surface. The impermeable wrapper is preferably pre-profiled with longitudinally extending grooves or corrugations; these may be discontinuous, with longitudinally grooved or corrugated lengths spaced apart by portions (e.g. plain or transversely corrugated or grooved) which in the finished filter close off longitudinal passages provided by the wrapper. Instead of corrugations, the impermeable wrapper could be embossed with dimples to provide in the finished product a network of random or ordered passages, the dimpled lengths of the wrapper again optionally being spaced apart by segments which are plain or configured so as to close off passages in the finished product.

Embodiments of the invention are described below, by way of example only, with reference to the accompanying schematic drawings (not to scale), in which like reference numerals denote like parts and in which.

Figure 1:
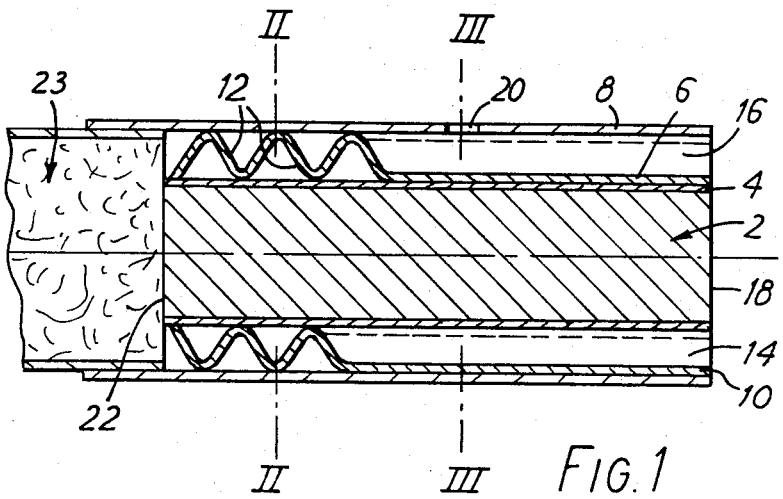
FIG. 1 is a longitudinal sectional view on line I—I of FIG. 3 of a filter and element according to the invention incorporated in a filter cigarette according to the invention.
Figure 2:
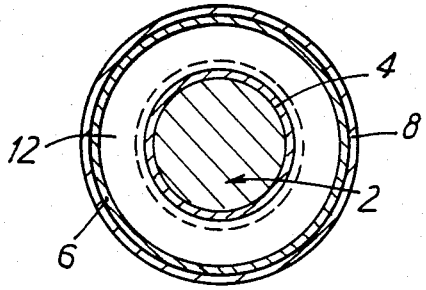
FIG. 2 is a fragmentary sectional view of the FIG. 1 element and filter taken on lines II—II of FIG. 1.
Figure 3:
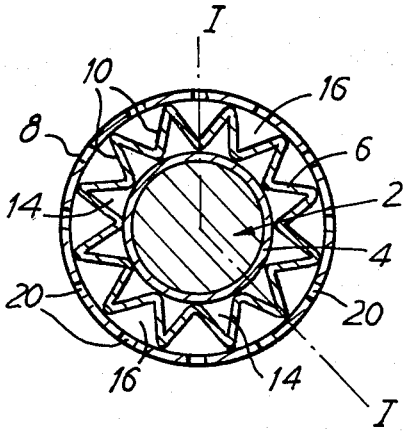
FIG. 3 is a sectional view of the FIG. 1 filter and element taken on lines III—III of FIG. 1.

The filter element illustrated in FIGS. 1 to 3 consists of a filter core made up of a plug 2 of filtering material wrapped in a smoke-permeable (inherently smoke-permeable and/or perforate) or smoke-impermeable plugwrap 4, and a smoke-impermeable wrapper 6 in surrounding engagement with the core; tipping material 8 in surrounding engagement with the impermeable wrapper completes the filter. The impermeable wrapper 6 has longitudinal corrugations 10 closed at one end 22 of the filter by circumferential corrugations 12, the longitudinal corrugations 10 providing passages 14 (FIG. 3) between core and impermeable wrapper and passages 16 between impermeable wrapper and tipping material, all of these passages being open at the end 18 of the filter. Tipping material 8 is of smoke-impermeable material but has a circumferential ring of perforations 20 via which passages 16 are in communication with the external air.

Tipping material 8 is a tipping overwrap which projects beyond the core and wrapper 6 to join the element to a wrapped tobacco column 23 at end 22; it could instead join the element to such a wrapped tobacco rod at the opposite end 18.

Impermeable wrapper 6 is a paper/polyethylene/paper laminate embossed with the illustrated longitudinal and transverse corrugations and secured around the core by a conventional lapped and stuck seam; it may also be adhered to the core along one or more longitudinal gum lines. Impermeable wrapper 6 does not compress the core or impress its pattern into its surface.

The plug 2 may be of any conventional smoke filtering material, e.g. bonded or unbonded fibres or continuous filamentary tow (e.g. of cellulose acetate, viscose, polyester or polyolefin), creped paper, foamed plastics etc. Where plug 2 is itself a dimensionally stable body (e.g. a cured bonded continuous filamentary cellulose acetate tow), and flow of smoke between core and passages 14 is to be permitted, the plugwrap 4 may be omitted. Where plug 2 is a composite of two or more abutting or longitudinally spaced elements, a plugwrap 4 may be preferred.

As indicated above, the filter may be attached to a tobacco rod either at end 18 or at end 22. In the former case, drawing on the mouth end 22 causes external air to flow in through perforations 20, along passages 16 to the end 18 of the filter, and then through the body of the filter from end 18 to end 22, diluting the smoke passing through the filter. When end 22 of the filter abuts the tobacco rod, drawing on the mouth end 18 causes external air to pass through perforations 20 and along passages 16 to the mouth end 18 so that the ventilating air passes directly into the smokers mouth before mixing with the inhaled smoke. Where plugwrap 4 is omitted or is perforate and/or inherently smoke-permeable, smoke will pass, in use of the filter, from the plug 2 into passages 14 and thence directly into the smoker's mouth (when filter end 22 is attached to the tobacco rod) or directly into passages 14 and thence into the smoker's mouth via plug 2 (when end 18 is attached to the tobacco rod). Where plugwrap 4 is of permeable filtering material, e.g. paper, this can enhance the total particulate retention of the filter.

Figure 4:
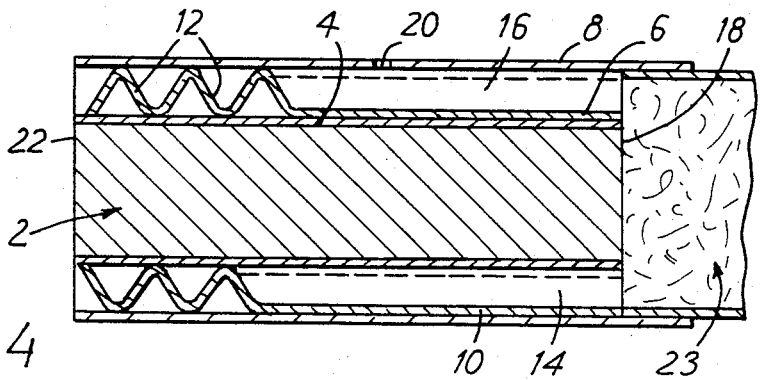
FIGS. 4 to 8 are longitudinal sectional views, similar to that of FIG. 1, of five further different filters and elements according to the invention incorporated in respective filter cigarettes according to the invention.
Figure 5:
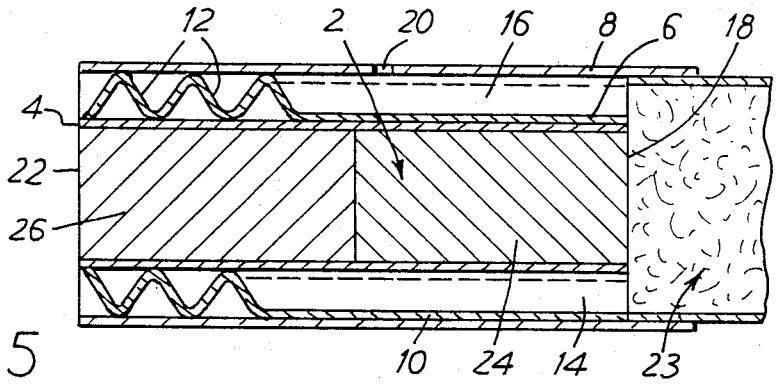
Figure 6:
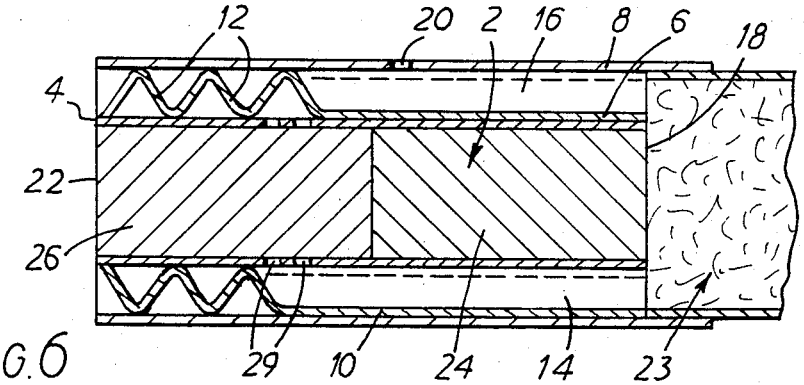

The filters and elements of FIGS. 4 to 6 are similar in structure to that of FIG. 1 and their appearance in cross-sectional view through the circumferentially and longitudinally grooved portions is similar to that shown in FIGS. 2 and 3 respectively.

In FIG. 4 the plug 2 has a porous plugwrap 4 which is of low initial pressure drop to allow passage of smoke but which is readily blockable by components of the tobacco smoke; the filter is attached at end 18 to a wrapped tobacco rod 23. On smoking the illustrated cigarette, the initial puffs result in appreciable by-pass of smoke along passage 14, the degree of by-pass reducing as the wrapper becomes blocked so that on subsequent puffs more of the smoke is obliged to traverse the full length of the filter plug 2. This arrangement helps to even out the taste delivery over the smoking of the cigarette. The taste delivery of a conventional ventilated filter cigarette increases during smoking from a low, often unsatisfying initial value to a high, often unacceptable, level; for a given overall delivery the FIG. 4 type of filter gives in comparison an increased initial and reduced final value and hence a more even smoke.

In the FIG. 5 embodiment, plug 2 is a composite of two elements 24 and 26 of different filtering characteristics. For example, element 24 may be of high pressure drop and element 26 of low pressure drop; in this case the plugwrap 4 is of naturally porous material and/or has perforations at least around the low pressure drop element 26, and the filter is attached to the wrapped tobacco rod 23 at end 18 so that the high pressure drop element 24 is against the tobacco. On initial smoking, smoke is thus encouraged to by-pass the high pressure drop element 24 by passing along passages 14 into the low pressure drop element 26. As with the previous embodiment, the plugwrap 4 may be readily blockable so that the degree of smoke by-pass varies during smoking of the cigarette. The individual segments can be different and chosen to give the required overall filtering characteristics.

In the FIG. 6 embodiment, where again the filter is attached to the tobacco rod at end 18, the plugwrap 4 is of impermeable material provided with perforations 29 at the closed ends of the grooves 14. The plug 2 may be unitary, or could again be a composite of a high pressure drop element adjacent to the tobacco and abutting a low pressure drop element surrounded by the perforations 29. On initial puffs, smoke from the tobacco rod passes along passages 14 and through perforations 29 into the plug 2, the perforations 29 eventually blocking so that more smoke is obliged to traverse the full length of the plug 2.

Figure 7:
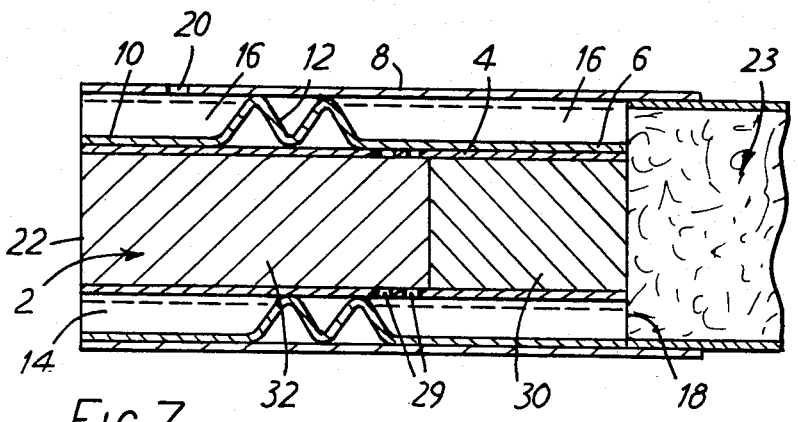

In the filter illustrated in FIG. 7, the core consists of a relatively high pressure drop plug 30 abutting a relatively low pressure drop plug 32 enwrapped in and joined by a plugwrap 4 of smoke-permeable material. The impermeable wrapper 6 in this case has circumferential corrugations 12 at an intermediate region along its length, longitudinal corrugations 10 extending therefrom to the opposite ends 18 and 22 of the filter. The filter is attached at end 18 to wrapped tobacco rod 23 by the tipping overwrap 8, whose ring of ventilation perforations 20 communicate with the passages 16 between impermeable wrapper 6 and overwrap 8 at the buccal end 22 of the filter. At the other end of the filter the passages 14 between impermeable wrapper 6 and the core are open to the tobacco. These passages 14 extend beyond the high pressure drop plug 30, and where they terminate around the upstream end of the low pressure drop plug 32 the plugwrap 4 is provided with fine perforations 29 which initially allow smoke from passages 14 to pass readily therethrough but after a few puffs become blocked so that an increasing amount of smoke is obliged to travel the full length of the core through plug 30 as well as plug 32. Not only does this give the effect obtained with the embodiments of FIGS. 4 to 6, but in addition the degree of air dilution into the smoker's mouth via perforations 20 and passages 16 increases from a relatively low initial value (when the perforations in plugwrap 4 are open so that the resistance to smoke flow is low) to a relatively high final value (when these perforations are blocked so that the resistance to smoke flow is at a maximum); the effect is thus to level out even more the taste delivery from first to final puff.

Figure 8:
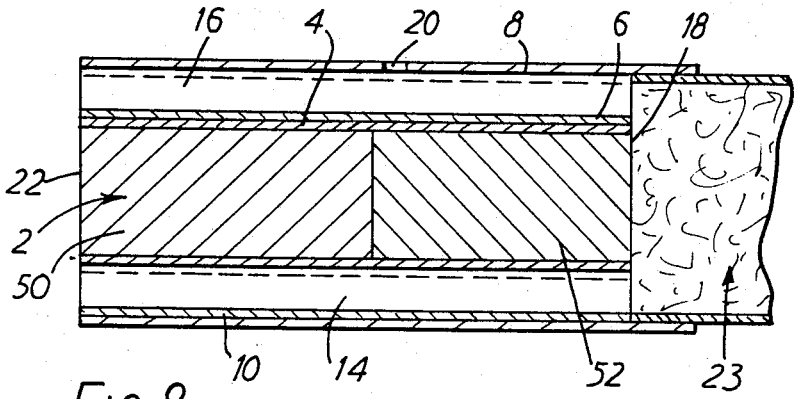

The FIG. 8 embodiment has a filtering core made up of a plug 50 of bonded cellulose acetate filamentary tow and an abutting plug 52 of creped paper, held together by a smoke-impermeable plugwrap 4. The smoke-impermeable wrapper has its longitudinal corrugations 10 extending the full length of the core to provide passages 14 and 16 each open at both ends of the filter. Tipping overwrap 8, of smoke-impermeable material with a ring of perforations 20 opening into passages 16, joins the filter to a wrapped tobacco column 23 and constitutes the tipping material of the filter.

Figure 9:
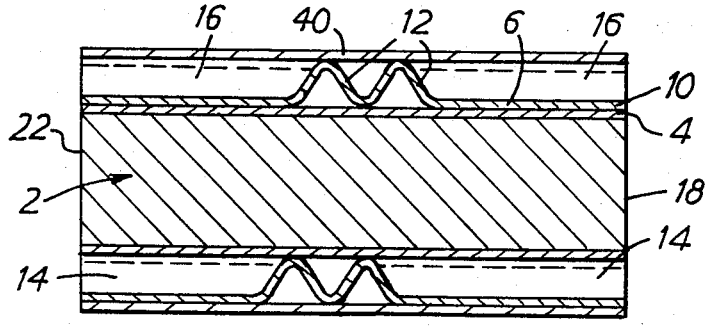
FIG. 9 is a similar longitudinal sectional view of yet another filter and element according to the invention.

In the embodiments of FIGS. 1 to 8, the tipping material of the filter has consisted of a tipping overwrap joining the element to a wrapped tobacco rod. The tipping material of a filter according to the invention can however be a conventional plain air-permeable plugwrap, as illustrated in FIG. 9. In this embodiment the core is an integral filtering plug 2 with a smoke-permeable plugwrap 4, the impermeable wrapper 6 around the core having intermediate circumferential and terminal longitudinal corrugations 12 and 10 respectively as in FIG. 7. Secured around impermeable wrapper 6 by a conventional lapped and stuck seam is a plain plugwrap 40 of air-permeable paper which is applied as a step in the production of the filter in continuous rod form which is then cut transversely to give the discrete filter length illustrated. Plugwrap 40 could instead be of air-impermeable material with perforations opening into passages 16. The filter may be joined at either end to a wrapped tobacco rod by means of ring tipping or a tipping overwrap having ventilation perforations communicating with passages 16 between wrapper 6 and external plugwrap 40.

Figure 10:
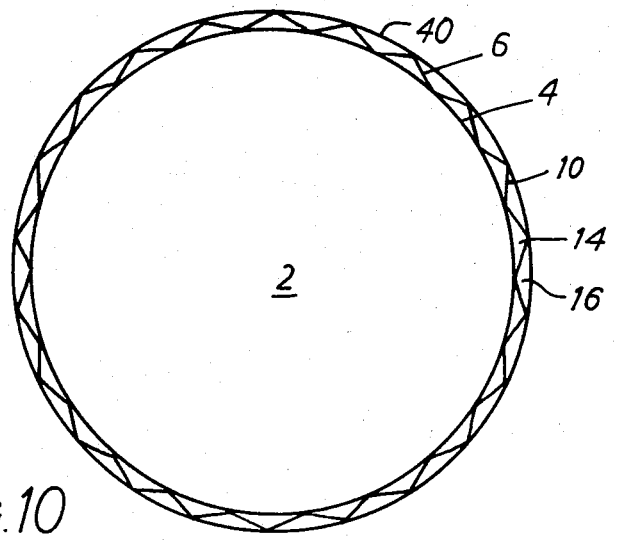
FIG. 10 is an end elevation, more to scale, of the FIG. 9 element and filter.

It will be appreciated that, for clarity of illustration, the drawings are not to scale; in general, the radial depth of the corrugations 10 is much exaggerated and their number and the core diameter are correspondingly reduced. In practice, substantially the whole of the diameter (about 8 mm) of a filter according to the invention will be taken up by the filtering core, corrugations 10 (and 12) having a radial depth of for example about 0.25 to 1 mm, e.g. 0.5 mm. Where only one peforation 20 has been shown for each passage 16, the perforations may be more closely spaced with two or more communicating with each passage 16. FIG. 10 illustrates an element and filter fo the FIG. 9 type more to scale, being an elevation view of end 22. It will be seen that in practice the core plug 2 is about 8 mm. in diameter and that the corrugations 10 in wrapper 6 provide about twenty-two internal and twenty-two external passages 14 and 16, each about 0.5 mm. deep. Similar dimensions apply in practice to the other embodiments illustrated herein in FIGS. 1 to 9 and 11 to 20.

Whilst reference is frequently made above and below to the use of a corrugated impermeable wrapper, other forms of profiled impermeable wrapper are possible. For example, the impermeable wrapper could be of a heavy duty paper (e.g. of 100 g/m$^2$ or more) such as cartridge paper with longitudinal grooves pre-formed therein, suitably by means of profiled impressing rollers; the surface of the paper could be left plain where the passages provided by the wrapper are to terminate.

In each of FIGS. 11 to 20 the filter element or rod comprises a filtering core (having a plug 2 and a plain smoke-permeable or -impermeable plugwrap 4) wrapped in a smoke-impermeable wrapper 6 with longitudinal corrugations 10 providing longitudinal passages 14 between wrapper and core and external longitudinal passages 16; in the elements of FIGS. 11 to 17 the impermeable wrapper also provides a circumferential groove 80 communicating with the said external grooves 16 which extend therefrom as shown to an end of the filter. In use, surrounding the filter element and joining it to a wrapped tobacco rod 23, is a ventilating tipping overwrap 8 having a ring of ventilating perforations 20 opening into the circumferential groove.

Figure 11:
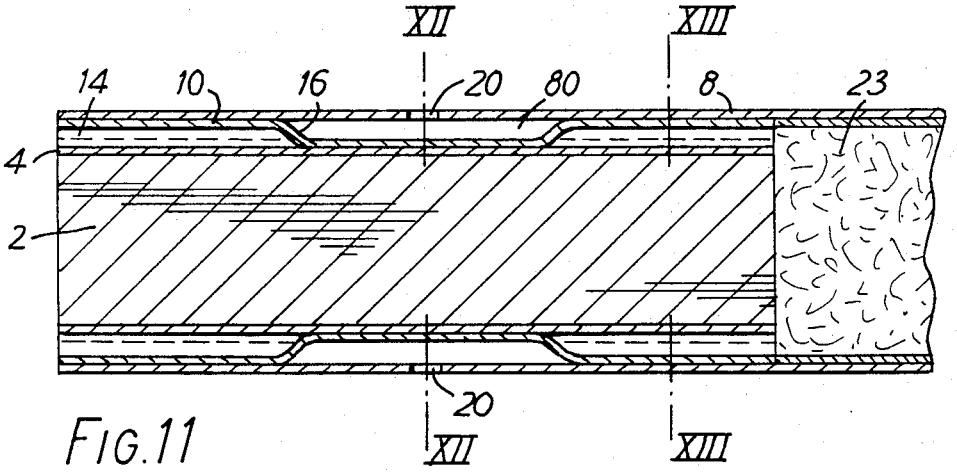
FIG. 11 is a longitudinal sectional view of another element, filter and filter cigarette according to the invention.
Figure 12:
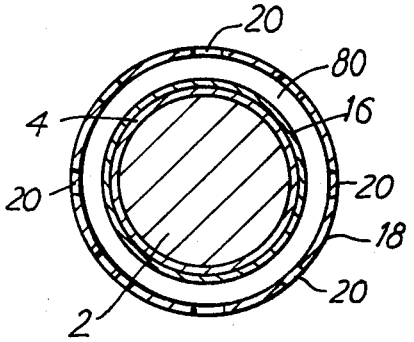
FIGS. 12 and 13 are cross sectional views along lines XII—XII and XIII—XIII respectively of FIG. 11.
Figure 13:
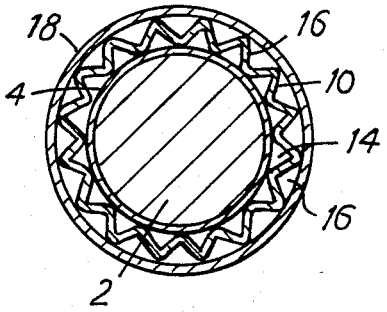
Figure 14:
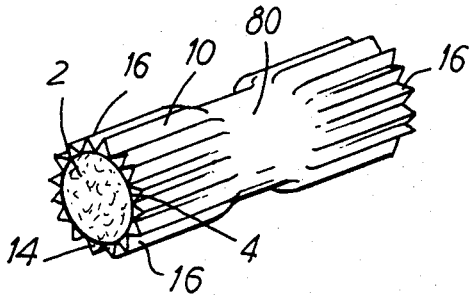
FIG. 14 is a perspective view of the filter element according to the invention employed in the filter of FIG. 11.
Figure 15:
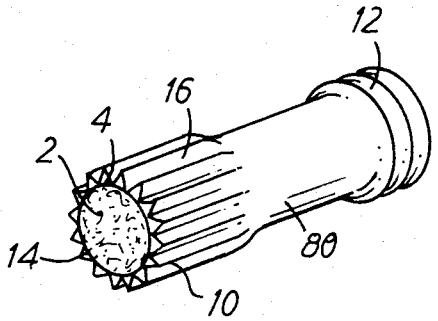
FIG. 15 is a view similar to FIG. 11 of another element, filter and filter cigarette according to the invention.
Figure 16:
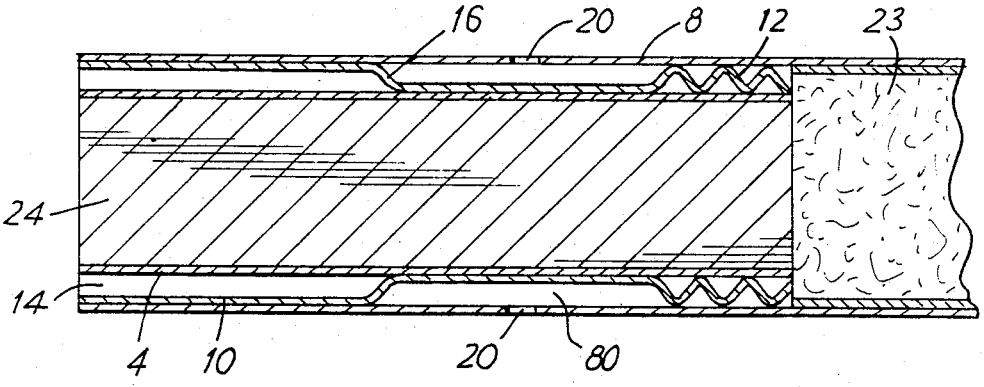
FIG. 16 is a perspective view of the filter element according to the invention employed in FIG. 15.

In the embodiment of FIGS. 11 to 14, internal and external passages extend longitudinally from the circumferential groove to both ends of the filter rod. In the embodiment of FIGS. 15 and 16, the impermeable wrapper at the end of the filter abutting the tobacco rod has circumferential corrugations 12 which close off the circumferential groove and the external channels from the tobacco rod, the circumferential groove being directly adjacent to the circumferential corrugations and the longitudinal corrugations of the wrapper extending therefrom to the buccal end of the filter. In the FIG. 17 element, which can be incorporated in a filter cigarette in the same manner as shown in FIGS. 11 and 15, the circumferential groove 80 is open to one end of the element, channels 14 and 16 extending therefrom to the opposite end.

As indicated above, in the formation of the illustrated filter elements, the initially flat wrapper 6 is first embossed with its sets of corrugations 10 (FIGS. 11 to 14 and 17) or 10 and 12 (FIGS. 15 and 16) with the spaces therebetween being left plain and unembossed. When the pre-corrugated wrapper is engaged around the core 24, the unembossed wrapper portions naturally distort to provide the circumferential groove 80 into which the channels 16 open.

Figure 17:
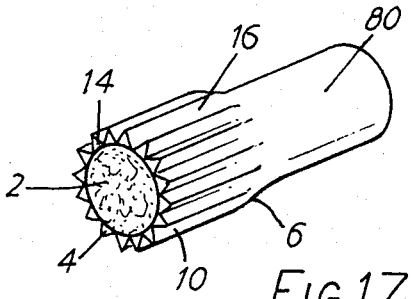
FIG. 17 is a view, similar to that of FIG. 16, of another filter element according to the invention.
Figure 18:
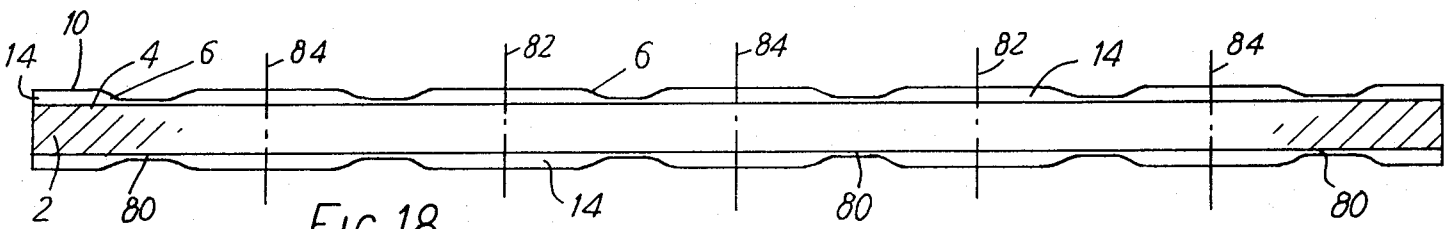
FIGS. 18 to 20 are schematic longitudinal sectional views of multiple length elements according to the invention.
Figure 19:
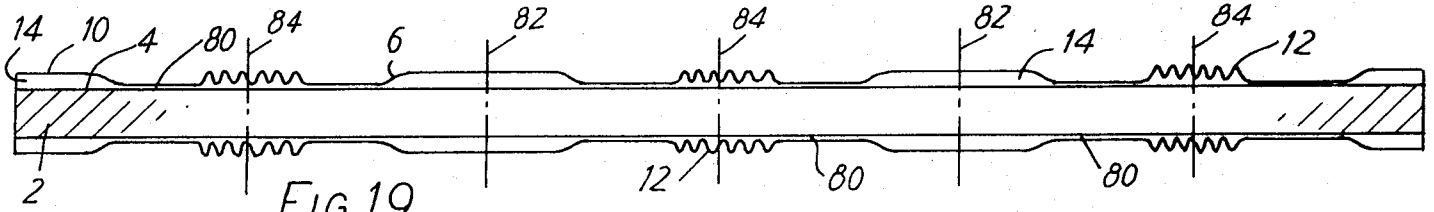
Figure 20:
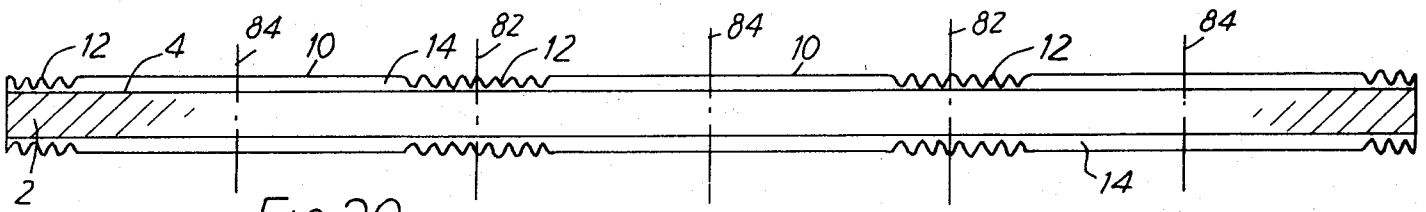

As previously explained, a filter element according to the invention such as any of those illustrated will initially be produced in a continuous length from which even multiple length rods (i.e. each rod being an even multiple of the eventual individual element) are cut, the multiple length rods subsequently being further subdivided into double length elements and then, during filter cigarette production, into the final single length elements. Examples of sextuple length rods according to the invention, which can be further subdivided into individual elements according to the invention, are illustrated schematically in FIGS. 18 to 20. FIG. 18 shows a sextuple length rod from which single elements as in FIG. 14 can be produced by cutting midway through the inboard longitudinally corrugated sections—firstly at positions 82 to yield double length rods and then, during filter cigarette manufacture as described above, at positions 84. A similar multiple length rod, but with appropriately different dimensions of the corrugated and circumferentially grooved regions, could be cut through the corrugations and grooves to yield elements as shown in FIG. 17. FIG. 19 shows a sextuple length rod which can be cut firstly at 82 midway through the inboard longitudinally corrugated regions and then at 84 midway through the circumferentially corrugated regions 12 to yield individual elements of the type shown in FIG. 16—in the finished filter cigarettes in this case, the filter element would be reversed compared to that in FIG. 15, with circumferential corrugations 12 at the buccal end; to produce the FIG. 15 product one would start with a FIG. 19 rod having the corrugations 12 at each end. FIG. 20 shows a sextuple length rod which can be cut through the corrugated regions 10 and 12 to yield individual elements, filters and filter cigarettes according to the invention (e.g. FIG. 1) having circumferential corrugations at one end of the element with the longitudinal corrugations extending therefrom to the other end—here the filter cigarette product would have the element oriented in the same manner as shown in FIG. 1, with corrugations 12 to the tobacco rod.

Whilst in all the illustrated embodiments the filtering core incorporates a plain plugwrap 4, the latter need not always be present, and when it is it may be smoke-permeable or -impermeable. The individual elements and multiple length rods illustrated in FIGS. 14 and 16 to 20 can be provided, as part of the filter manufacturing procedure, with a plain air-permeable plugwrap. The wrapped elements or filters could then be incorporated in filter cigarettes by a ventilating tipping overwrap as shown in FIGS. 11 and 15, or by ring tipping.

What is claimed is:

1. A smoke filter element having opposite ends and comprising a filtering core, a smoke impermeable wrapper in surrounding engagement with the core, at least one internal passage defined between the impermeable wrapper and core and open at an end of the element, and at least one external passage defined by the outer surface of the impermeable wrapper and extending to an end of the element.

2. An element according to claim 1 wherein the impermeable wrapper has a profile providing the said passages.

3. A smoke filter element having opposite ends and comprising a filtering core, and a corrugated smoke impermeable wrapper defining internal passages between the wrapper and core which extend longitudinally to an end of the element and external passages externally of the wrapper which extend longitudinally to an end of the element.

4. An element according to any of claims 1 to 3 having such passages which extend from end to end of the element.

5. An element according to any of claims 1 to 3 having at least one such passage extending only partially the length of the core.

6. An element according to claim 4 having such passages terminated or interrupted by circumferential corrugation of the wrapper.

7. An element according to any of claims 1 to 3 wherein the impermeable wrapper has a circumferential groove into which at least one such external passage opens.

8. An element according to any of claims 1 to 3 wherein at least one such passage has a terminal or intermediate constriction.

9. A cigarette filter comprising an element according to claim 3 having engaged around said impermeable wrapper tipping material which provides, when the filter is drawn on in use, for the ingress of external air laterally therethrough into said external passages.

10. A filter element rod comprising a plurality of unit elements according to claim 1, 2 or 3 disposed end-to-end and integrated by a common said impermeable wrapper extending the full length of the rod, each said unit element being disposed in mirror-image relationship to the or each integrally adjacent unit element.

11. A cigarette filter comprising opposite ends, a filtering core, a smoke-impermeable wrapper in surrounding engagement with the core, tipping material in surrounding engagement with the impermeable wrapper, at least one internal passage defined between the impermeable wrapper and core and open at an end of the filter, and at least one external passage defined between the impermeable wrapper and tipping material and open at an end of the filter, the tipping material having at least one perforation for the ingress of external air laterally into said external passage.

12. A filter according to claim 11 or 9 having such passages which extend the full length of the filter to open at both ends of the filter.

13. A filter according to claim 11 or 9 having such internal and external passages which open at the same end of the filter and extend only partially towards the other end of the filter.

14. A filter according to claim 11 or 9 wherein the tipping material comprises an external plugwrap which does not extend beyond the ends of the core.

15. A filter according to claim 11 or 9 wherein said tipping material is constituted at least in part by a tipping overwrap joining the filter to a wrapped tobacco rod.

16. A filter according to claim 11 or 9 wherein the impermeable wrapper has a circumferential groove into which at least one such external passage opens and said tipping material provides, when the filter is drawn on in use, for the ingress of external air laterally therethrough directly into said circumferential groove.

* * * * *